US005458331A

United States Patent [19]

Bothwell

[11] Patent Number: 5,458,331

[45] Date of Patent: Oct. 17, 1995

[54] GAME RACKET WITH ADJUSTABLE STRING SUSPENSION SYSTEM

[76] Inventor: Brett P. Bothwell, 101 W. 75th St. (#3B), New York, N.Y. 10023-1812

[21] Appl. No.: 235,335

[22] Filed: Jul. 22, 1994

[51] Int. Cl.[6] ..... A63B 51/12

[52] U.S. Cl. ..... 273/73 E; 273/73 C; 273/73 D; 273/73 G; 273/73 L

[58] Field of Search ..... 273/73 R, 73 C, 273/73 D, 73 E, 73 G, 73 L

[56] References Cited

U.S. PATENT DOCUMENTS

| | | | |
|---|---|---|---|
| 1,558,507 | 10/1925 | Ryder | 273/73 E |
| 3,904,202 | 9/1975 | DeLorean . | |
| 3,999,756 | 12/1976 | Head . | |
| 4,206,917 | 6/1980 | Guillem et al. | 273/73 E |
| 4,512,576 | 4/1985 | Dahlgren . | |
| 4,566,695 | 1/1986 | Melby . | |
| 4,613,138 | 9/1986 | Haythornthwaite . | |
| 4,772,021 | 9/1988 | Maynard . | |
| 4,909,511 | 3/1990 | DeVille et al. . | |
| 4,995,608 | 2/1991 | von Hackewitz . | |
| 5,029,859 | 7/1991 | Davis | 273/73 R |
| 5,083,776 | 1/1992 | Liu . | |

*Primary Examiner*—Raleigh W. Chiu

[57] ABSTRACT

The string suspension system comprises a primary racket frame (12) joined about the racket head (14) by two suspension frames (22 and 22') to form dual volumetrically adjustable air chambers (44 and 44') within a head assembly (16). Within each of the two air chambers (44 and 44') is located an inflatable suspension bladder (54 and 54') which, when pressurized, induces an outward expansion of the suspension frames (22 and 22'). The tension of the strings (30) laced through both the racket head (14) and the suspension frames (22 and 22') thus increases when this pressure induced transformation occurs.

24 Claims, 8 Drawing Sheets

GAME RACKET

HEAD ASSEMBLY

HEAD ASSEMBLY

VALVE CHAMBER (NON-PRESSURIZED)

(PRESSURIZED)

VALVE SYSTEM

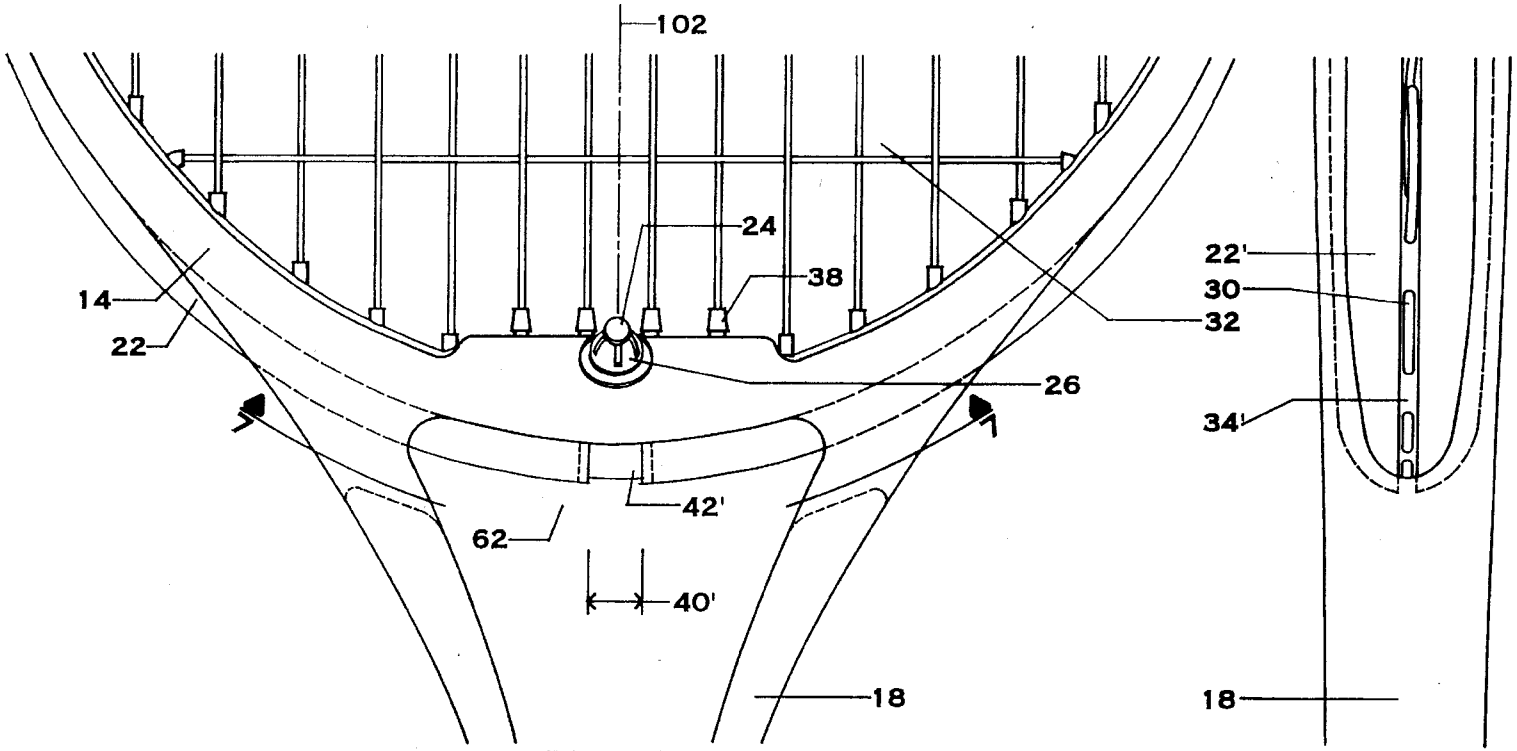
FIG. 7C
FIG. 7A
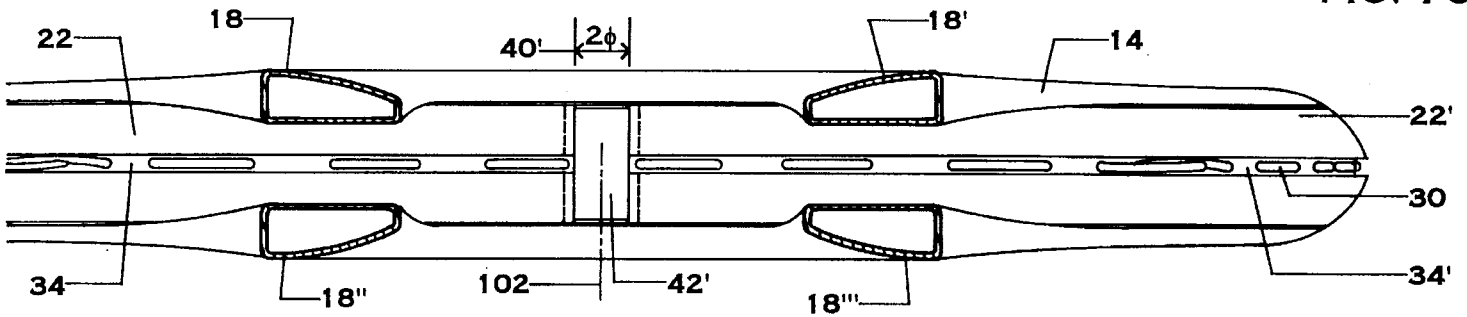
FIG. 7B

PROTECTIVE BUMPER

GAME RACKET WITH ADJUSTABLE STRING SUSPENSION SYSTEM

FIELD OF THE INVENTION

This invention relates to game rackets, in particular tennis rackets, which typically are provided with a woven stringed surface for hitting a game ball.

BACKGROUND OF INVENTION

Recent history of game racket technology has as its focus a number of critical issues regarding the playability of stringed rackets. Since the advent of the oversized tennis racket, great emphasis has been placed on the size and location of the "sweet spot". Simply put, the "sweet spot" is the zone of optimum response on a stringed hitting surface. Direct contact with a game ball in this zone is likely to result in maximum power and control with reduced effort and reduced physical discomfort associated with off-center contact. Power and control are, at least in part, on the degree of rebound of a ball that strikes the stringed surface, i.e., the velocity of an incoming ball compared to the velocity with which the ball leaves the stringed surface, known as the "coefficient of restitution." The sweet spot is directly related to the rebound of a ball at different locations on the stringed surface, where rebound is at a minimum near the edges of the stringed surface, i.e., near the ends of the strings.

Efforts to expand the sweet spot with various modifications to the size and shape of the head and to the density and type of the string weave have been somewhat successful. However, the sweet spot of a conventional game racket still remains limited to a relatively small percentage of its stringed surface. A major drawback common to these previous efforts can be defined as a "fixed node" stringing system. "Fixed node" describes the condition of the string ends or nodes as secured to the racket frame about the periphery of the hitting surface. The fixed node stringing system is responsible for the limited size of the sweet spot and the lack of rebound near the edges of the racket. Consequently, any attempt to enlarge the sweet spot of a conventional racket is limited by the nature of the fixed node.

String tension can radically affect the playing characteristics of a game racket. Factors considered in determining a suitable tension can include string type and elasticity, racket frame stiffness, and playing conditions to name a few. More often than not, these factors vary from match to match. It is, therefore, desirable for a game racket stringing system to provide for tension adjustability without the need for a complete restringing. Conventional attempts to achieve this have utilized complicated hardware which often added undesirable weight to the racket. The adjustable tension racket of von Hackewitz U.S. Pat. No. 4,995,608 employs a cumbersome nut and bolt assembly that induces its adjustment from a centralized location such that the resulting tension on the stringed surface becomes uneven. This mechanism also requires that the head be discontinuous and susceptible to distortion and improper shock distribution.

A common goal of many game racket designs is the reduction or isolation of impact shock or vibration which increases with off-center contact. This unwanted shock or vibration is believed to be a cause of "tennis elbow" and other types of arm related injuries. Numerous attempts have been made to isolate and dampen the shock by various means of impact attenuation. These post-reaction oriented approaches, however, make no attempt to eliminate the transfer of impact shock to the frame, but respond only to the shock as transmitted from the stringed surface to the frame after it occurs. The anti-shock air cushions of Liu U.S. Pat. No. 5,083,776 are a good example of this trend. The cushions, located at the periphery of the racket head between the secured ends of the strings are intended to dampen the response of impact. This approach still results in high levels of vibration in the racket frame. Still other approaches have utilized shock absorption mechanisms in the handle grip. Nonetheless, all of these devices are designed to compensate for the inherent characteristics of the fixed node stringing system.

Another conventional approach to shock reduction is disclosed by Maynard U.S. Pat. No. 4,772,021 in which a stringed inner head frame of the "fixed node" type is suspended within the head of a racket by means of an inflatable rubber tube. The flexible inflatable tube is the sole source of lateral stability and does not provide sufficient resistance to its own tendency to roll. Thus, the extreme pressure necessary to stabilize the inner frame results in excessive clearances which render the racket inconvenient and impractical to use.

Elasticity of the string itself is also a serious consideration in the making of a game racket. It is disclosed as an object of Head U.S. Pat. No. 3,999,756, the oversized racket, for the string response to imitate as closely as possible, the performance of animal gut while making use of a far more durable yet less elastic synthetic string. To accomplish this, Head increased the length of the strings by enlarging the racket head size. This approach does not correct for the lack of rebound close to the fixed nodes at the periphery of the racket. Recent development of more durable and less elastic string, notably the wound steel type, increases the desirability of a racket that enhances the rebound of stringed surface and improves shock absorbency.

The ability of a string to maintain its tension over a period of time, is a major factor in its durability and playability. As a string begins to stretch and lose tension, it tends to rub across the adjacent strings more easily thereby increasing the chance that the string will be weakened and break. The option of decreasing the tension in the strings will minimize stretching and thereby increase the longevity and tension retention of the string. Thus, string longevity and tension retention would be a desirable game racket characteristic.

The preferred embodiment of this game racket with an adjustable air pressurized string suspension system offers a wide range of enhanced playing characteristics. Replacement of the fixed node system with a "suspended node" system results in a major increase in the size of the sweet spot, a significant increase in dwell time (actual time that a game ball has contact with strings) owing to the enhanced playing characteristics of the stringed surface, and a decrease in impact shock transmitted to the racket frame. Also improved are string playability and durability to name a few of the improvements. Add to these benefits a tension adjustment capability and it becomes clear that the present invention signifies a major breakthrough in game racket technology.

The numerous advantages achieved by the present invention can be attributed to the suspended node or air pressurized configuration of the stringing system. "Node" refers to the point at which the string is secured to the periphery of a racket frame head. Typically a stringed hitting surface is woven directly to the frame. Though the given tensile force in the string may be consistent, the rebound characteristic is not. The midpoint of the string span tends to offer greater rebound than its secured ends. "Suspended node" refers to a non-fixed or suspended point of string bearing which, in this particular embodiment, is movable in two opposite directions generally along a string axis. The suspended node allows a reduction in the rebound difference at a strings midpoint compared to near its termination at the periphery of the racket head.

OBJECTS AND SUMMARY OF THE INVENTION

It is an object of this invention to provide a game racket of conventional size and shape and made of high strength lightweight composite materials of the type commonly used in current racket construction.

It is yet another object of this invention to provide a game racket with improved performance. It is still another object of this invention to provide a racket which replaces the fixed node stringing system with a suspended node system. It is still another object of the present invention to improve rebound towards the perimeter of the stringed surface and thus expand the sweet spot.

It is yet another object of this invention to provide adjustable string tension capability without the need for restringing, while remaining within accepted design standards of size, shape, and weight.

It is an additional object of this invention to suspend the stringed surface within the head of the racket frame utilizing a fully integrated air pressure system to absorb shock.

It is still another object of this invention to increase string durability and prolong the life of optimum response characteristics.

Further objects and advantages will become apparent from consideration of the ensuing description and drawings.

BRIEF DESCRIPTION OF THE DRAWINGS

FIG. 7A is a view of a throat of the racket when fully pressurized;

FIG. 7B is a sectional view, along line 7—7 in FIG. 7A, of the throat showing a slip joint between two suspension frames;

FIG. 7C is a side view of the throat;

DETAILED DESCRIPTION OF THE INVENTION

Figures 1A, 1B:
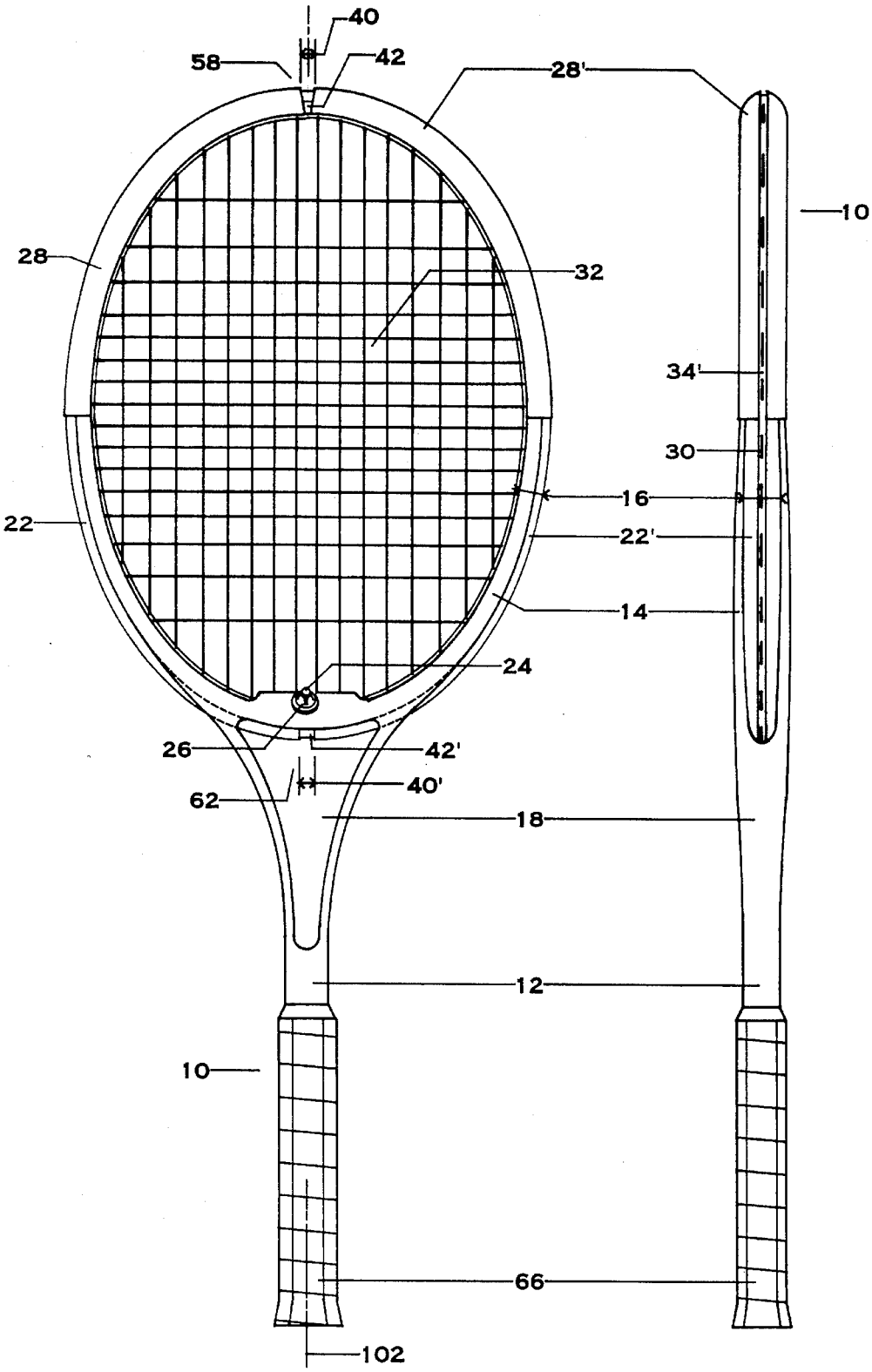
FIGS. 1A and 1B show front and side views of a game racket constructed in accordance with the present invention.

The preferred embodiment of a game racket 10 constructed in accordance with the present invention is illustrated in FIGS. 1A and 1B. Both the front and side views of FIGS. 1A and 1B respectively show the racket 10, a primary frame 12 and a throat 18 which connects a head 14 to a handle end 66. The primary frame 12 is joined about its head 14 by a first suspension frame 22 and a second suspension frame 22' to form a head assembly 16. The head assembly 16 has a top end 58 and a bottom end 62 and defines the perimeter of a stringed hitting surface 32. Protective bumpers 28 and 28' are secured in place along the perimeter of the head assembly 16. For clarity, the entire protective bumpers 28 and 28' are not shown. An air pressure valve 24 is disposed at the bottom end 62 of the head assembly 16. A first slip joint 40 and a slip joint closure 42 are positioned at the top end 58 of the head assembly 16 and a second slip joint 40' and slip joint closure 42' are positioned at the bottom end 62 of the assembly 16. Slip joints 40 and 40' are aligned with the longitudinal axis 102 of the racket 10 and allow movement within the head assembly 16 which will be described herein. FIG. 1B shows a side view of the racket 10 in which the strings 30 and a grommet strip 34' is secured to the suspension frame 22'.

It is desirable in this preferred embodiment that all primary components of the racket 10 be as lightweight and durable as possible. All primary components, such as the primary frame 12 and the suspension frames 22 and 22', may be made of a variety of materials well-known to those skilled in the art as suitable for this purpose, such as high strength composite material including graphite or Kevlar™, and fabricated by conventional methods known to those skilled in game racket construction, such as high temperature injection molding.

Figures 2A, 2B:
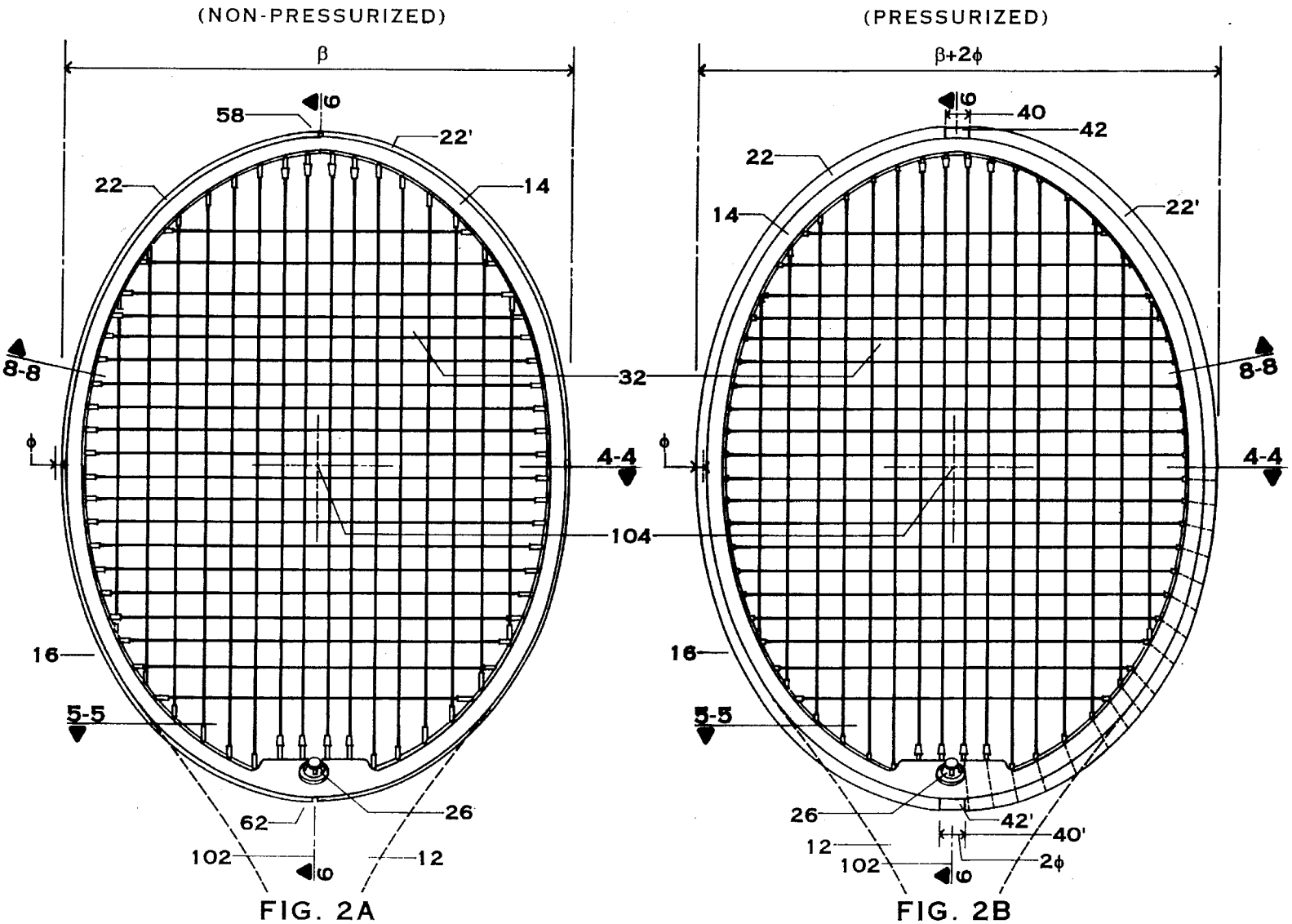
FIGS. 2A and 2B show front views of a racket head assembly pressurized and non-pressurized.

FIG. 2A shows a view of the head assembly 16 in its non-pressurized position. FIG. 2B shows a view of the assembly 16 in its fully pressurized position. For purposes of clarity, the protective bumpers 28 and 28' are not shown. Displacement of the first suspension frame 22 and the second suspension frame 22' in the pressurized and non-pressurized positions is indicated by the difference in the outer dimension of the assembly 16 as represented by θ. In the preferred embodiment, utilizing conventional materials, it is estimated that θ, or the difference between minimum and maximum expansion, is about 9/32 inch. The width of the racket 12 across the head assembly 16 in its non-pressurized position, is represented by β. The width across the assembly 16 in its fully pressurized position is referred to as β+2θ. The pressure-induced movement of the suspension frames 22 and 22' will be approximately radial and will depend on the configuration of and materials used in the head assembly 16.

Figure 3:
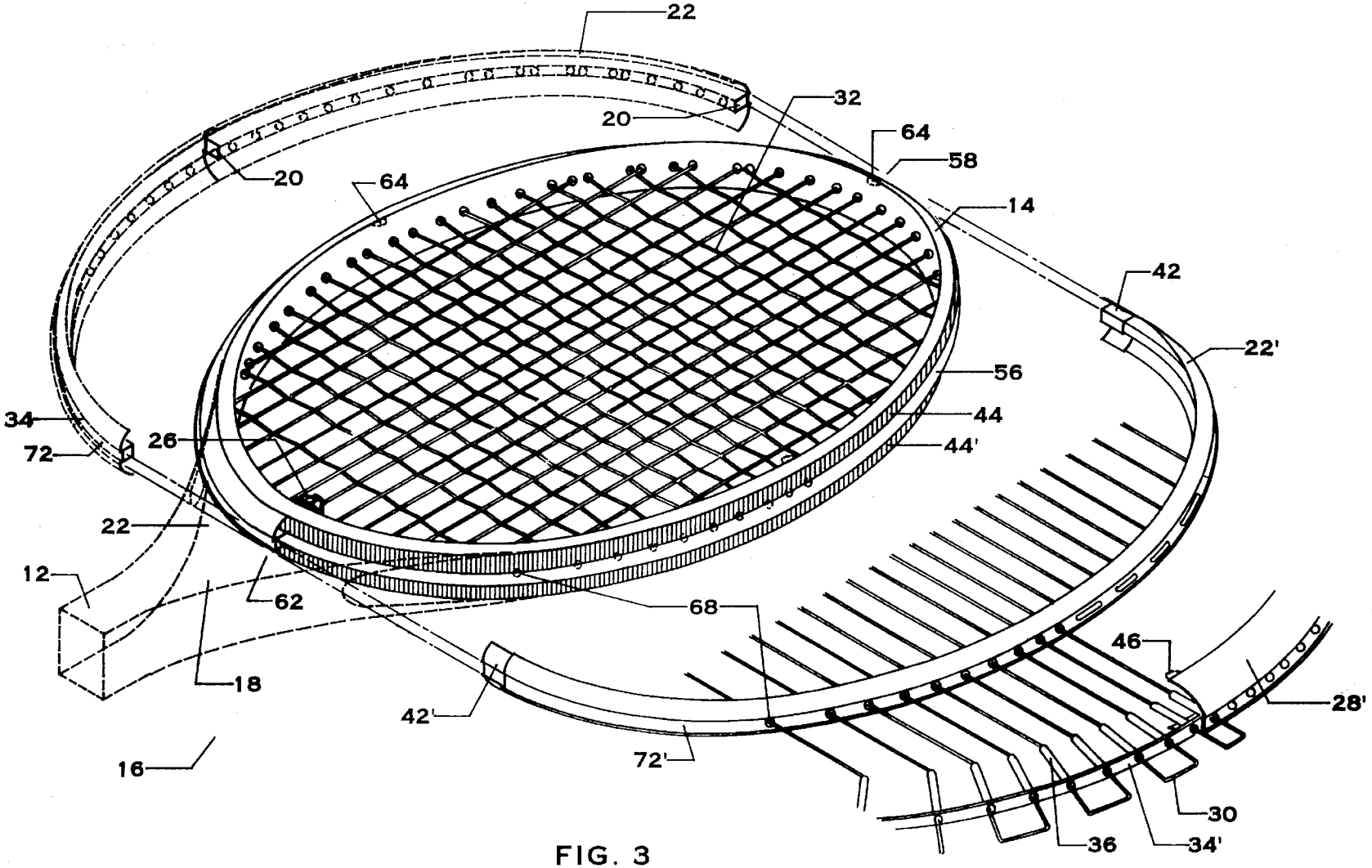
FIG. 3 shows an exploded view of the head assembly.

In FIG. 3 the exploded view shows the stringed hitting surface 32 interlaced with various components of the head assembly 16. To facilitate integration of the stringed surface 32 with the head assembly 16, aligned holes 68 pass through slip channel keys 20 and 20' of the suspension frames 22 and 22', and a slip channel 56 in the head 14 to provide the basis for the stringing pattern.

When slidably engaged about the outer periphery of the head 14, at the slip channel 56, the suspension frames 22 and 22' interlock via the slip joint closures 42 and 42' to form two separate contiguous volumetrically adjustable air chambers 44 and 44' within the head assembly 16. FIG. 3 also shows a first slip joint closure 42 attached or integral to one end of the frame 22' at the top end 58 of the head assembly 16 and slidably engaged into one end of the suspension frame 22. A second slip joint closure 42' is attached or integral to the second end of the frame 22' at the bottom end 62 of the head assembly 16 and slidably engaged into the second end of the frame 22. Sufficient overlap and clearance to allow for smooth sliding between the two movable frames 22 and 22' must be provided. Seated in grommet strip channels 72 and 72' on the outer periphery of both the first frame 22 and the second frame 22' and inserted through the slip channel keys 20 and 20' and the head 14 are the grommet strips 34 and 34' with integral grommets 36. The diameter of each of the aligned holes 68, as previously outlined, is slightly larger than that of the grommet 36.

FIG. 3 also shows fastening tab sockets 64 which slidably receive the fastening tabs 46 integral with the protective bumpers 28 and 28' (28 is not shown here). The protective bumpers 28 and 28' protect the entire perimeter of the suspension frame.

Figure 4A:
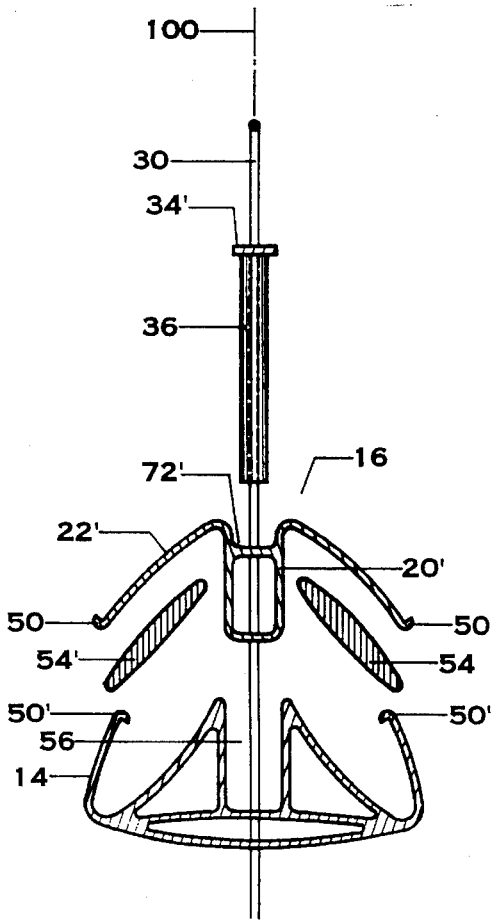
FIG. 4A is an exploded sectional view, along line 4—4 in FIGS. 2A and 2B, of the head assembly.

FIG. 4A is a cross section of a unassembled head assembly 16. In FIG. 4A, the grommet 36 and grommet strip 34', laced through with a string 30, are shown prior to insertion into the frame 22'.

Figure 4C:
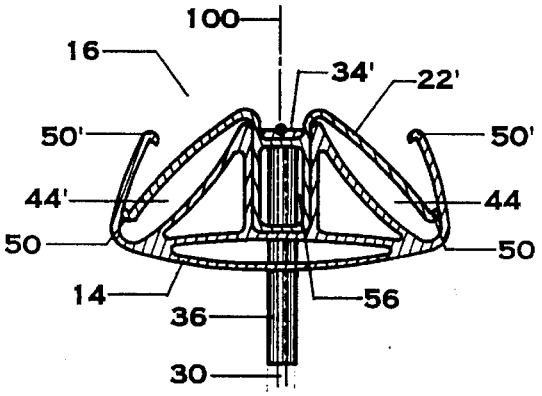
FIG. 4C is a sectional view of a non-pressurized head assembly without a bladder.
Figure 4D:
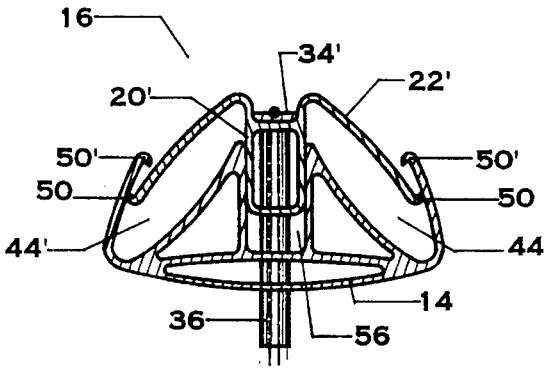
FIG. 4D is a sectional view of a partially pressurized head assembly without a bladder.
Figure 4B:
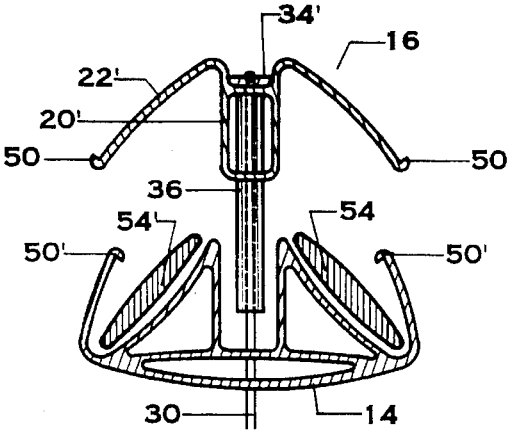
FIG. 4B is a sectional view, along line 4—4 in FIGS. 2A and 2B, of the head assembly partially assembled.

FIG. 4B is a cross sectional detail of a partially assembled head assembly 16. FIG. 4B shows the grommet 36, the grommet strip 34', and the string 30 inserted through the slip channel key 20' integral with the suspension frame 22', prior to engagement with the head 14. This configuration shall be known as the "suspended node". Aligned holes 68 (as shown in FIG. 3) in the head 14, allow for inward and outward movement along the axis of tensile adjustment 100, of the grommet 36 and string 30.

In order for the frame 22' to "snap" into position within the head 14 and for the expansion lock tabs 50 to lock together with the expansion look tabs 50', the width of the frame 22' profile must be slightly greater than that of the head 14 profile. Flexure of the frame 22' to engage the head 14 is indicated by the extension lines in FIG. 4B. The gauge and composition of material used for the frames 22 and 22' should be ductile enough to flex into its engaged position yet strong enough to resist any deformation due to stringing or use.

The inflatable suspension bladders 54 and 54' are shown in FIG. 4B at their assembled location within two separate cavities in the head 14. In a fully assembled head assembly 16 (see FIGS. 6A and 6B) an inflatable bladder 54 lines the interior of one volumetrically adjustable air chamber 44 and a second bladder 54' lines the second air chamber 44'. A suitable lubricant may be employed within each of the two air chambers 44 and 44' to facilitate smooth expansion and contraction of the bladders 54 and 54' and prolong bladder life.

Figure 4E:
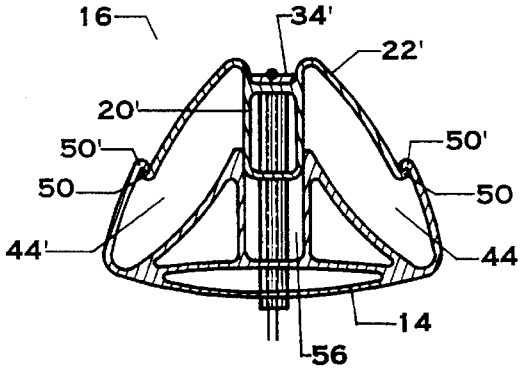
FIG. 4E shows a fully pressurized head assembly without a bladder.

FIGS. 4C, 4D, and 4E show the slip channel key 20', integral with the frame 22', slidably engaged with the head 14 at the slip channel 56. The bladders 54 and 54' are not shown in FIGS. *4c*, *4d*, and *4e*. When non-pressurized, as shown in FIG. 4C, the tabs 50 and 50' are disengaged, slip channel key 20' is fully engaged with channel 56, and the string 30 is at its minimum tension. At any intermediate position between minimum and maximum pressure, as shown in FIG. 4D, an outward force will be exerted upon the interior of each of the volumetrically adjustable air pressure chambers 44 and 44' by the tabs 50. At maximum pressure, as shown in FIG. 4E, the expansion lock tabs 50 and 50' are fully engaged, slip channel key 20' is partially engaged with channel 56, and the string 30 is pulled to maximum tension. The expansion lock tabs 50 and 50' will thus keep the air chambers 44 and 44' sealed, help to negate structural moment forces about the centroid of the slip channel 56, and provide a mechanical limitation to the outward movement of the suspension frame 22'. A suitable lubricant may be employed to facilitate smooth movement within the head assembly 16.

Figure 5C:
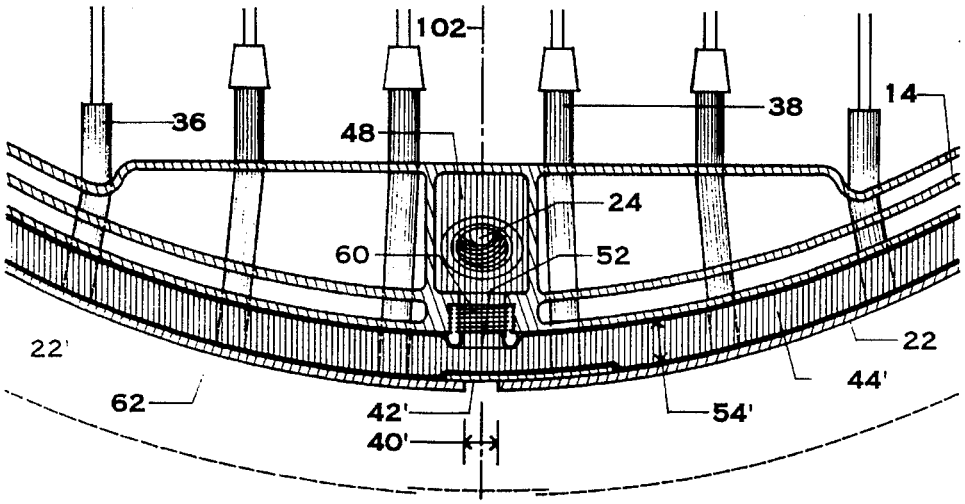
FIG. 5C is a sectional view, along line 5—5 in FIG. 5A, showing the valve chamber and one air chamber non-pressurized.
Figure 5B:
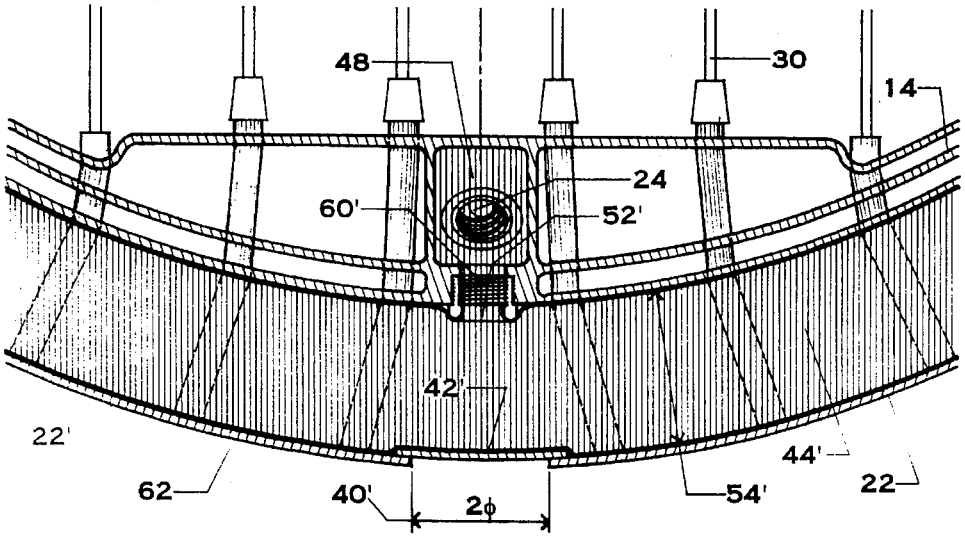
FIG. 5B is a sectional view, along line 5—5 in FIG. 5A, showing the valve chamber and one volumetrically adjustable air chamber fully pressurized.
Figure 5A:
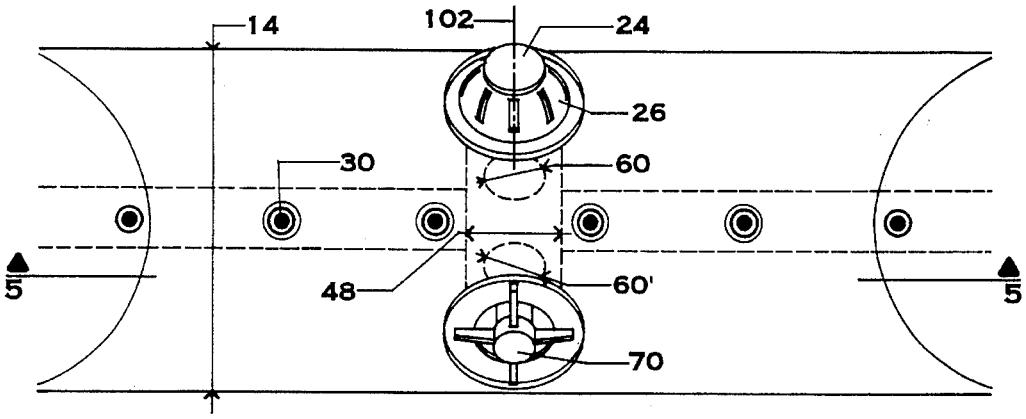
FIG. 5A is a plan view, along line 5—5 in FIGS. 2A and 2B, of an air pressure valve at the throat of the racket.

In this preferred embodiment of the present invention, the adjustable air pressurization system is centrally located at the bottom end 62 of the head 14 adjacent to the throat 18 of the frame 12 as shown in FIGS. 5A, 5B, and 5C. FIG. 5A shows a plan view of the exterior of the air pressure valve 24 and the adjustable pressure release valve 70. A valve chamber 48 and two threaded pressure ducts 60 and 60' are shown as phantom lines within the head 14. FIG. 5B is a sectional view showing the valve chamber 48 and one volumetrically adjustable air chamber 44' fully pressurized. FIG. 5C is a sectional view showing the valve chamber 48 and one air chamber 44' non-pressurized. Connected into the head 14 and into the chamber 48, the valve 24 and the adjustable pressure release valve 70 are made of lightweight materials having the strength and hardness necessary to form a durable, substantially fluid tight seal. The chamber 48 can be pressurized via the air pressure valve 24 and pressure can be released either by the air pressure valve 24 or the pressure release valve 70.

Figure 6A:
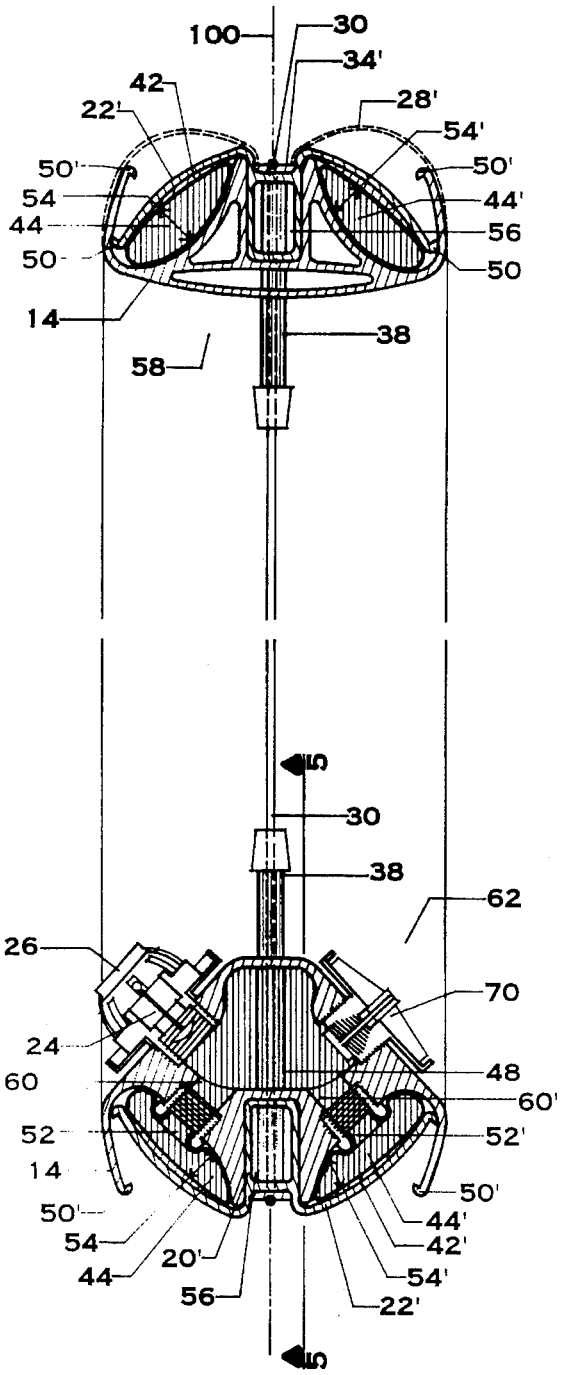
FIG. 6A is a sectional view taken along line 6—6 in FIG. 2A, of the head assembly non-pressurized showing the valving system.
Figure 6B:
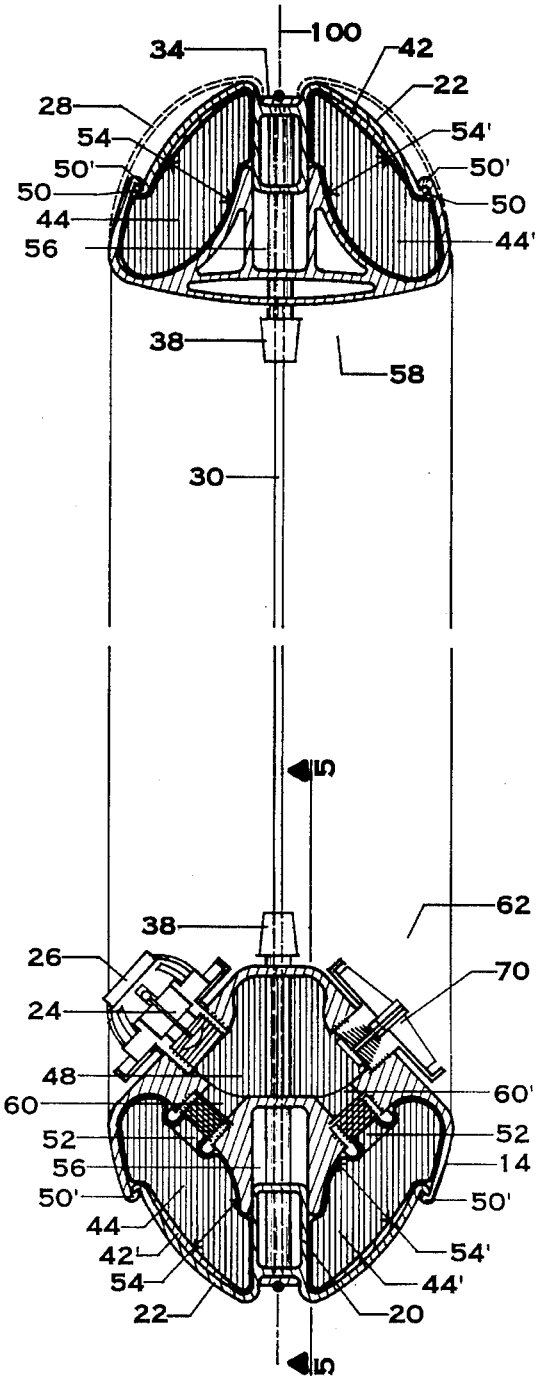
FIG. 6B is a sectional view taken along line 6—6 in FIG. 2B, of the head assembly fully pressurized showing the valving system.

FIGS. 6A and 6B are sectional views showing both the top end 58 and the bottom end 62 of the head assembly 16. FIG. 6A shows the head assembly 16 non-pressurized. FIG. 6B shows the head assembly 16 fully pressurized. Acting to synchronize pressurization in each of the two separate volumetrically adjustable air chambers 44 and 44', the chamber 48 disperses air simultaneously via a first duct 60 and a second duct 60'. Within the first air chamber 44 there exists one inflatable suspension bladder 54 and within a second air chamber 44' there exists a second bladder 54'. The first bladder 54 has a stem 52 which joins with the chamber 48 at the first duct 60 and the second bladder 54' has a stem 52' which joins with the chamber 48 at a second duct 60'. A substantially fluid tight seal is provided when the stems 52 and 52' are inserted into their respective ducts 60 and 60'.

The intersection of the throat 18 and the head assembly 16 is detailed further in FIGS. 7A, 7B, and 7C. FIG. 7A shows the air pressure valve 24 mounted to the head 14. The frames 22 and 22' intersect at the slip joint 40' via the closure 42' and is shown in a fully pressurized position. FIG. 7B shows a four pronged or open throat 18, 18', 18'', and 18''' configuration of the frame 12 enabling the first frame 22 and the second frame 22' to pass uninterrupted about the periphery of the head 14. FIG. 7C is a side view showing the strings 30 and the grommet strip 34' secured to the suspension frame 22' and passing uninterrupted through an opening in the side of the throat 18 of the racket frame 12.

Figure 8A:
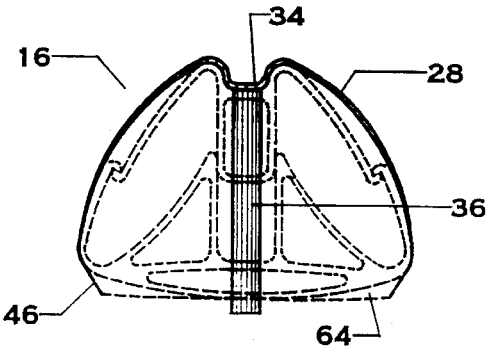
FIG. 8A is a sectional view, along line 8—8 in FIG. 2B, of a protective bumper integral with a grommet strip positioned in a fully pressurized head assembly.
Figure 8B:
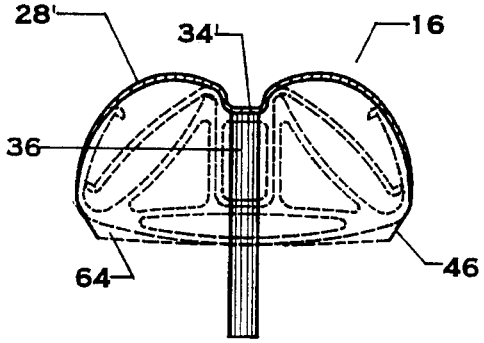
FIG. 8B is a sectional view, along line 8—8 in FIG. 2A, of a protective bumper integral with a grommet strip positioned in a non-pressurized head assembly.
Figure 8C:
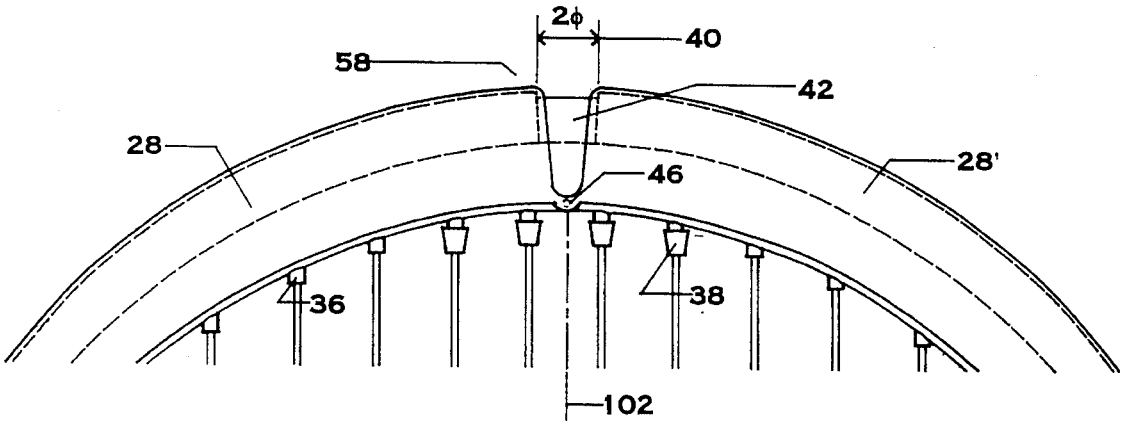
FIG. 8C is a side view of the protective bumper on a fully pressurized head assembly.

FIG. 8A shows the protective bumper 28 secured to a fully pressurized head assembly 16. FIG. 8B shows the bumper 28 secured to a non-pressurized head assembly 16. The bumper 28, integral with the grommet strip 34 and grommet 36, is attached to the head 14 with a plurality of fastening tabs 46 which are inserted into the fastening tab sockets 64 located at various points about the inner periphery of the head 14. The composition of the bumper 28 and strip 34 is pliable enough to allow for repeated expansion and contraction of the frame 22 yet strong enough to provide protection from damage during use and to prevent foreign matter from entering either of the two air chambers 44 or 44'.

It is estimated that, in the preferred embodiment, using a string of conventional elasticity, a variable tension range of approximately 10 pounds will make acceptable use of the adjustable air pressurization system. The system represented in the preferred embodiment allows for approximately 9/16 of an inch of string length adjustment to achieve this end.

The game racket of this invention should be strung in its non-pressurized position at or below the lowest desired tension. Suspension and increased tension of the stringed surface occurs by attaching a source of compressed gas to the air pressure valve (cover off) and releasing air into the valve chamber. The air pressure could be introduced by use of a high pressure $CO_2$ cartridge, similar to those presently used for pressurizing bicycle tires and the Instapump™ used on high performance athletic sneakers manufactured by Reebok. Other sources of air pressure exist that could also be used, but the convenience of the hand-held high pressure cartridge is most desirable.

The valve chamber simultaneously inflates each of the two suspension bladders, pressurizes the volumetrically adjustable air chambers, and thus suspends the suspension frames on a cushion of air. Maximum string tension occurs when the expansion lock tabs become fully engaged. Minimum tension is obtained by using the air pressure valve or pressure release valve to release the air from the system.

The preferred means of setting the desired pressure, and thus the string tension, is to utilize an adjustable pressure release valve. Acting as a regulatable vent to the pressure system, the valve could be preset to release air when the desired pressure is attained and then set to a locked position to prevent further leakage of air pressure. The pressure release valve would also act as a safety valve to eliminate the possibility of rupture due to over-inflation or string breakage and prevent over-stretching of stings.

String longevity may be extended and optimum performance may be prolonged by storing the racket between periods of use in its non-pressurized position thereby minimizing the tendency for the string to stretch out and lose its resiliency.

It can be seen that the game racket with an adjustable air pressurized string suspension system of this invention has improved rebound of the stringed surface and thus the size of the "sweet spot" and dwell time. In addition, impact shock is reduced and the tension adjustment capability provides for adaptability to given conditions of play as well as prolonged string life. In addition, as a string stretches and loses tension, the racket can be pressurized to a greater pressure to keep consistent string tension.

Although the previous description of the present invention in its preferred embodiment contains many specificities, it is to be understood that these should not limit the scope of the invention but rather represent merely the presently preferred embodiments. The representation complies with conventional properties of size, shape, and weight primarily to demonstrate the immediate applicability of the air suspension system to currently accepted standards of game racket construction.

The invention is adaptable to various head shapes and modified stringing patterns. Further, advances in composite material technology could allow the use of one continuous suspension frame made of an elastic yet rigid composite. It may also be possible to suspend the suspension frames with just one volumetrically adjustable air chamber.

In an alternate embodiment, regulation of the air pressure could be via a detachable adjustable pressure regulation nozzle, adapted to regulate air flow in increments suitable for the intended application. The pressure regulation nozzle could allow incremental release of air pressure or be set to only allow a pre-set air pressure to be introduced. The pressure regulation nozzle could be marked in increments of pressure which correlate to the tension in the string.

In another alternative embodiment, the components are sized and adapted to create a substantially fluid tight air chamber or dual chambers without the use of an inflatable suspension bladder. This embodiment reduces the weight of the racket by eliminating the weight of the inflatable bladders.

In another alternative embodiment, the grommets strip has a number of restraining grommets that serve to restrain the suspension frames from excessive movement away from the racket head. These restraining grommets would have a truncated cone at their unattached end, whereby the larger end of the truncated cone would be closest to the grommet strip. The diameter of the larger end of the truncated cone would be slightly larger than the hole in the racket head through which the restraining grommet is inserted. This added safety feature would restrain the suspension frame from moving too far from the racket head in case of over-pressurization or string breakage.

Still another embodiment locates the valving system of the pressurization system at the handle end of the racket. This alternate embodiment could be used if adjustments are desired in weight distribution.

The embodiments described herein are examples of how the invention can be executed. Therefore the scope of the invention should be determined by the appended claims and their legal equivalents, rather than by the examples given.

I claim:

1. A game racket comprising:

(a) a primary racket frame comprised of a handle connected to a racket head;

(b) a suspension frame surrounding the circumference of said racket head, said suspension frame adapted to receive strings under tension; and (c) a volumetrically adjustable substantially fluid tight chamber disposed between said primary racket frame and said suspension frame, said chamber being capable of receiving a fluid medium and holding said fluid medium under pressure, said chamber disposed so as to isolate said primary racket frame from said suspension frame and slidably move said suspension frame with respect to said primary racket frame when the internal volume of said chamber is adjusted.

2. A game racket in accordance with claim 1 wherein said game racket includes a means for introducing and withdrawing a fluid medium from said chamber.

3. A game racket in accordance with claim 1 wherein said fluid tight chamber is an inflatable bladder.

4. A game racket in accordance with claim 1 wherein said chamber is comprised of a plurality of segregated sections.

5. A game racket in accordance with claim 1 further comprising a protective bumper surrounding the circumference of said suspension frame.

6. A game racket in accordance with claim 1 further comprising a means for measuring the pressure in said chamber.

7. A game racket in accordance with claim 1 further comprising a means for maintaining a preselected pressure.

8. A game racket in accordance with claim 1 wherein said suspension frame is comprised of a plurality of sections.

9. The game racket in accordance with claim 8 wherein said sections are substantially circular arcs.

10. The game racket of claim 8 wherein said sections are substantially elliptical arcs.

11. A game racket in accordance with claim 1 wherein said suspension frame is provided with a mating rectangular protruding ring and said primary racket frame is provided with a rectangular channel provided with a longitudinal bore disposed on the circumference of the racket head which is adapted to slidably engage said mating rectangular protruding ring in said suspension frame, wherein the bore of said channel is slightly larger than the width of said ring, to prevent movement of said suspension frame in a direction perpendicular to the racket head.

12. A game racket in accordance with claim 1 wherein said suspension frame and said primary racket frame are provided with a retaining means to restrict the movement of the suspension frame away from the center of the racket head.

13. A game racket comprising:

(a) a primary racket frame comprised of a handle connected to a racket head;

(b) a suspension frame surrounding the circumference of said racket head, said suspension frame adapted to receive strings under tension;

(c) a plurality of holes disposed about the circumferences of said primary racket head and said suspension frame;

(d) a volumetrically adjustable substantially fluid tight chamber disposed between said racket head and said suspension frame, said chamber being capable of receiving a fluid medium and holding said fluid medium under pressure, said chamber disposed so as to isolate said primary racket frame from said suspension frame and slidably move said suspension frame with respect to said racket head when the internal volume of said chamber is adjusted; and (e) a grommet strip disposed on the circumference of said suspension frame, said grommet strip provided with a plurality of grommets, said grommets disposed in said holes in said racket head and said suspension frame, said grommets provided with an attached end attached to said grommet strip and a free end opposite said attached end, said free end having the shape of a truncated cone with the greatest diameter of said truncated cone sized larger than said holes and disposed closest to said attached end, said grommets disposed to restrain the movement of said suspension frame away from the center of said racket head.

14. A game racket comprising:

A. a primary racket frame comprised of a handle connected to a racket head;

B. a suspension frame surrounding the circumference of said racket head, said suspension frame adapted to receive strings under tension; and C. a volumetrically adjustable substantially fluid tight chamber disposed between said primary racket frame and said suspension frame, said chamber being capable of receiving a fluid medium and holding said fluid medium under pressure, said chamber disposed so as to isolate said primary racket frame from said suspension frame and slidably move said suspension frame with respect to said primary racket frame when the internal volume of said chamber is adjusted, said suspension frame provided with a mating rectangular protruding ring and said primary racket frame provided with a rectangular channel provided with a longitudinal bore disposed on the circumference of the racket head which is adapted to slidably engage said mating rectangular protruding ring in said suspension frame, wherein the bore of said channel is slightly larger than the width of said ring, to prevent movement of said suspension frame in a direction perpendicular to the racket head.

15. A game racket in accordance with claim 14 wherein said game racket includes a means for introducing and withdrawing a fluid medium from said chamber.

16. A game racket in accordance with claim 14 wherein said fluid tight chamber is an inflatable bladder.

17. A game racket in accordance with claim 14 wherein said chamber is comprised of a plurality of segregated sections.

18. A game racket in accordance with claim 14 further comprising a protective bumper surrounding the circumference of said suspension frame.

19. A game racket in accordance with claim 14 further comprising a means for measuring the pressure in said chamber.

20. A game racket in accordance with claim 14 further comprising a means for maintaining a preselected pressure.

21. A game racket in accordance with claim 14 wherein said suspension frame is comprised of a plurality of sections.

22. The game racket in accordance with claim 21 wherein said sections are substantially circular arcs.

23. The game racket of claim 21 wherein said sections are substantially elliptical arcs.

24. A game racket in accordance with claim 14 wherein said suspension frame and said primary racket frame are provided with a retaining means to restrict the movement of the suspension frame away from the center of the racket head.

* * * * *